US009893435B2

(12) United States Patent
Bily et al.

(10) Patent No.: US 9,893,435 B2
(45) Date of Patent: Feb. 13, 2018

(54) COMBINED ANTENNA APERTURES ALLOWING SIMULTANEOUS MULTIPLE ANTENNA FUNCTIONALITY

(71) Applicants: Adam Bily, Seattle, WA (US); Mohsen Sazegar, Kirkland, WA (US); Nathan Kundtz, Kirkland, WA (US); Ryan Stevenson, Woodinville, WA (US)

(72) Inventors: Adam Bily, Seattle, WA (US); Mohsen Sazegar, Kirkland, WA (US); Nathan Kundtz, Kirkland, WA (US); Ryan Stevenson, Woodinville, WA (US)

(73) Assignee: KYMETA CORPORATION, Redmond, WA (US)

( * ) Notice: Subject to any disclaimer, the term of this patent is extended or adjusted under 35 U.S.C. 154(b) by 60 days.

(21) Appl. No.: 14/954,415

(22) Filed: Nov. 30, 2015

(65) Prior Publication Data

US 2016/0233588 A1 Aug. 11, 2016

Related U.S. Application Data

(60) Provisional application No. 62/115,070, filed on Feb. 11, 2015.

(51) Int. Cl.

| | |
|---|---|
| ***H01Q 21/24*** | (2006.01) |
| ***H01Q 21/30*** | (2006.01) |
| ***H01Q 25/00*** | (2006.01) |
| ***H01Q 21/06*** | (2006.01) |
| ***H01Q 21/00*** | (2006.01) |
| ***H01Q 5/42*** | (2015.01) |

(52) U.S. Cl.

CPC ..... *H01Q 25/00* (2013.01); *H01Q 5/42* (2015.01); *H01Q 21/0012* (2013.01); *H01Q 21/061* (2013.01); *H01Q 21/064* (2013.01); *H01Q 21/065* (2013.01)

(58) Field of Classification Search

CPC .. H01Q 21/0006; H01Q 21/061; H01Q 21/24; H01Q 21/30; H01Q 25/00; H01Q 21/0012; H01Q 21/064

See application file for complete search history.

(56) References Cited

U.S. PATENT DOCUMENTS

| | | | | |
|---|---|---|---|---|
| 4,101,901 | A * | 7/1978 | Kommrusch | H01Q 21/205 343/844 |
| 4,623,894 | A | 11/1986 | Lee et al. | |
| 5,757,324 | A * | 5/1998 | Helms | H01Q 1/42 343/700 MS |
| 2002/0003502 | A1 * | 1/2002 | Falk | H01Q 13/10 343/771 |

(Continued)

OTHER PUBLICATIONS

Notification of Transmittal of the International Search Report and the Written Opinion of the International Searching Authority, or the Declaration issued for International Patent Application No. PCT/US2016/016390, dated May 24, 2016.

*Primary Examiner* — Hoang Nguyen

(74) *Attorney, Agent, or Firm* — Blakely, Sokoloff, Taylor & Zafman LLP

(57) ABSTRACT

An antenna apparatus and method for use of the same are disclosed herein. In one embodiment, the antenna comprises a single physical antenna aperture having at least two spatially interleaved antenna arrays of antenna elements, the antenna arrays being operable independently and simultaneously at distinct frequency bands.

53 Claims, 17 Drawing Sheets

(56) References Cited

U.S. PATENT DOCUMENTS

| | | | | |
|---|---|---|---|---|
| 2002/0171601 | A1* | 11/2002 | Puente Baliarda .... | H01Q 1/246<br>343/893 |
| 2004/0090387 | A1 | 5/2004 | Desargant et al. | |
| 2004/0145526 | A1* | 7/2004 | Puente Baliarda .... | H01Q 1/246<br>343/700 MS |
| 2004/0189540 | A1 | 9/2004 | Schadler | |
| 2006/0256024 | A1 | 11/2006 | Collinson | |
| 2013/0300602 | A1* | 11/2013 | Zhou ..... | H01Q 3/247<br>342/372 |
| 2014/0009357 | A1 | 1/2014 | Tiezzi et al. | |

* cited by examiner

COMBINED ANTENNA APERTURES ALLOWING SIMULTANEOUS MULTIPLE ANTENNA FUNCTIONALITY

PRIORITY

The present patent application claims priority to and incorporates by reference the corresponding provisional patent application Ser. No. 62/115,070, titled, "COMBINED ANTENNA APERTURES ALLOWING SIMULTANEOUS MULTIPLE ANTENNA FUNCTIONALITY," filed on Feb. 11, 2015.

FIELD OF THE INVENTION

Embodiments of the present invention relate to the field of antennas; more particularly, embodiments of the present invention relate to an antenna having combined aperture that operates with multiple frequencies simultaneously using interleaved arrays.

BACKGROUND OF THE INVENTION

There are a limited number of antennas that can receive multiple polarizations and frequencies simultaneously. For example, the DirecTV Slimline 3 Dish reflector antenna receives multiple polarizations and frequencies simultaneously. In this product, there are 2 Ka-band receivers and 1 Ku-band receiver operating simultaneously from the same reflector. This is accomplished by placing multiple feeds at different locations along the focal axis of the reflector. In this case, based on the pointing of the dish and the positioning of the 3 receivers, simultaneous reception from 3 satellites (99°, 101°, 103°) is achieved, with the Ka-band satellites providing 2 circularly polarized signals simultaneously. The DirectTV Slimline 5 Dish reflector antenna sees 5 satellites simultaneously—99°, 101°, 103°, 110°, 119°. (99, 103° is the Ka-band). The operations of these products are limited to receive.

Two limitations of such dish-based antennas are that a dish needs to be pointed towards the satellite and that the angular difference between the look angles of 2 or more feeds within 1 reflector is limited to approximately 10 degrees, e.g., Slimline 5 (99°-119°). This is dependent heavily on the shape of a dish, which can be engineered to various specifications. However, all dishes rely on a focusing behavior to achieve directivity, and thus the more focusing needed to close the link, the less angular coverage is achievable for a reflector dish having a constant area.

Another commonly used approach to achieve dual frequency simultaneous performance is dual-band arrays comprised of radiating elements having 2 operating bands. These are often realized using resonant patches or similar shapes such as ring resonators. One recent example is described in U.S. Pat. No. 8,749,446, entitled "Wide-band linked-ring Antenna Element for Phase Arrays," issued Jun. 10, 2014. This implementation allows neighboring commercial and military Ka receive bands to be covered simultaneously, which are 17.7-20.2 GHz for commercial and 20.2-21.2 for military. However, there is no ability to point at more than 1 source simultaneously. Furthermore, there is no system level allowance described giving sufficient isolation to support simultaneous transmit and receive operation.

Thus, typically, with dishes that must simultaneously point in largely different directions (more than an estimated 10 degrees difference), that must track earth orbiting satellites (O3b installation with two gimbaled dishes), or communicate across largely different frequency bands, two completely separate antennae and systems are required. This increases size, cost, weight and power.

SUMMARY OF THE INVENTION

An antenna apparatus and method for use of the same are disclosed herein. In one embodiment, the antenna comprises a single physical antenna aperture having at least two spatially interleaved antenna arrays of antenna elements, the antenna arrays being operable independently and simultaneously at distinct frequency bands.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1:
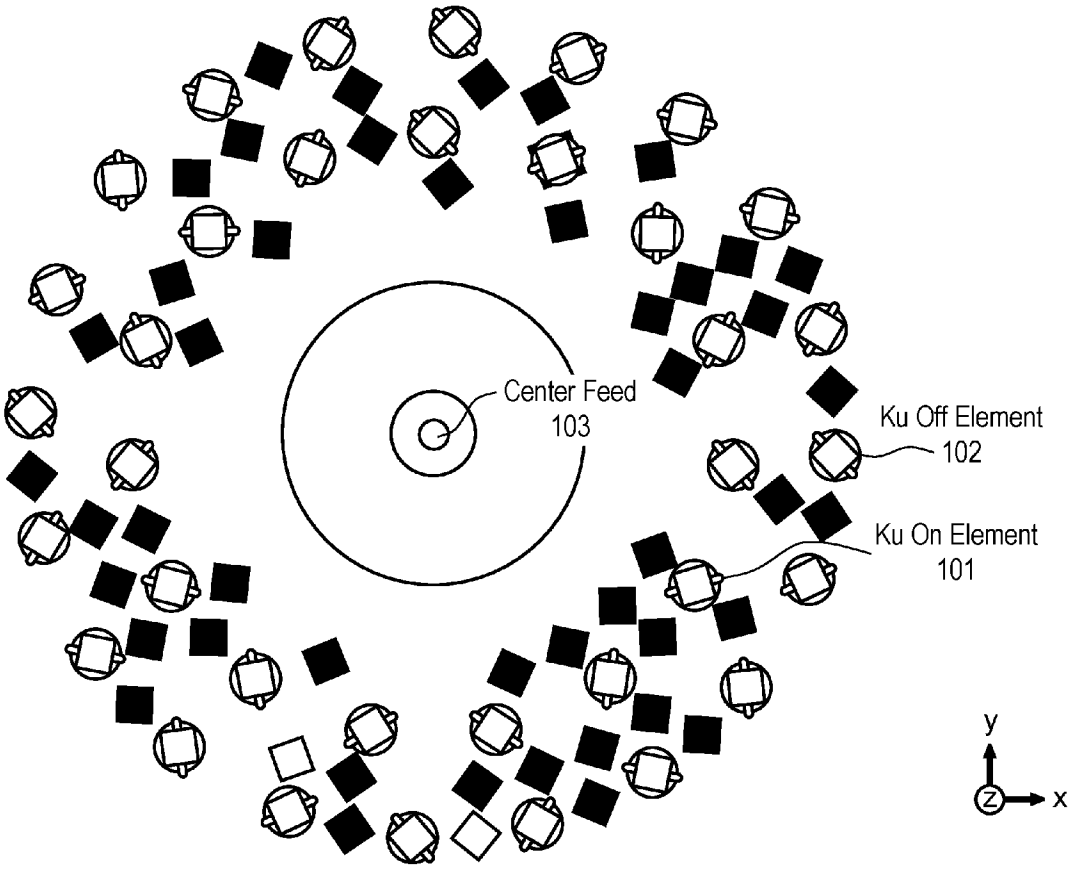
FIG. 1 illustrates one embodiment of a dual reception antenna showing the Ku-band receive antenna elements.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

An antenna apparatus having a combined aperture that simultaneously supports a combination of transmission and reception, dual band transmission or dual band reception is disclosed. In one embodiment, the antenna comprises two spatially interleaved antenna arrays of antenna elements combined in a single physical aperture, where the antenna arrays are operable independently and simultaneously at multiple frequencies and a single, radial continuous feed coupled to the aperture. The two antenna arrays are combined into a single, flat-panel, physical aperture. The techniques described herein are not limited to combining two arrays into a single physical aperture, and can be extended to combining three or more arrays into a single physical aperture.

In one embodiment, the pointing angles of the antenna arrays are different such that one of the antenna sub-arrays can form a beam in one direction while another antenna sub-array can form a beam in another, different direction. In one embodiment, the antenna can form these two beams with an angular separation between the beams of more than 10 degrees. In one embodiment, the scan angle is ±75 or ±85 degrees, which provides much more freedom for communication.

In one embodiment, the antenna includes two antenna arrays that are combined into one physical antenna aperture. In one embodiment, the two antenna arrays are interleaved transmit and receive antenna arrays operable to perform reception and transmission simultaneously. In one embodiment, the transmission and reception are in the Ku transmit and receive bands, respectively. Note that Ku-band is an example and the teachings are not limited to specific bands.

In another embodiment, the two antenna sub-arrays are interleaved dual receive antenna operable to perform reception in two different receive bands and pointing at two different sources in two different directions simultaneously. In one embodiment, the two bands comprise the Ka and Ku receive bands.

In yet another embodiment, the two antenna sub-arrays are interleaved dual transmit antenna operable to perform transmission in two different transmit bands and pointing at two different receivers in two different directions simultaneously. In one embodiment, the two bands comprise Ku and Ka transmit bands.

In one embodiment, each of the antenna arrays comprises a tunable slotted array of antenna elements. Therefore, for one combined physical antenna aperture having two apertures, there are two slotted arrays of antenna elements. The antenna elements of these two slotted arrays are interleaved with each other.

In one embodiment, the tunable slotted array for one of the antenna sub-arrays has a number of antenna elements and element density that is different than that of a second antenna sub-array. In one embodiment, most, if not all, elements in each of the tunable slotted arrays of two or more antenna arrays are spaced $\lambda/4$ with respect to each other. In another embodiment, most elements, if not all, in each of the tunable slotted arrays of two or more antenna arrays are spaced $\lambda/5$ with respect to each other. Note that some antenna elements of one or more of the slotted arrays may not have this spacing because locations needed to meet such spacing are occupied by antenna elements of another antenna array.

In one embodiment, elements in each of the tunable slotted arrays of the arrays are positioned in one or more rings. In one embodiment, one of the rings of antenna elements that operate in one frequency has a different number of antenna elements than another ring of antenna elements in the same aperture that operate at a second, different frequency. In another embodiment, at least one of the rings has antenna elements of multiple (e.g., two, three) slotted arrays. In yet another embodiment, there are rings of different sizes for different frequencies. For example, one ring has antenna elements of a first size for a first frequency while another ring has antenna elements of a second size, larger than the first size, for a second frequency that is lower than the first frequency.

In another embodiment, the antenna sub-arrays are controllable to provide switchable polarization. In one embodiment, the different polarizations that the sub-arrays can be controlled to provide include linear, left-handed circular (LHCP) or right-handed circular polarization. In one embodiment, the polarization is part of the holographic modulation that determines the beam forming and the direction of the main beam. More specifically, the modulation pattern is calculated to determine which elements of the sub-arrays are on and off and that determines the polarization. In one embodiment of the holographic beam forming antenna, the polarization of the received and transmitted signal can be switched dynamically by software (e.g., software in an antenna controller). Moreover, in one embodiment, the transmitted and received signals (or signals of two beams at two different frequencies) can have different polarizations.

In one embodiment, each slotted array comprises a plurality of slots and each slot is tuned to provide the desired scattered energy at a given frequency. In one embodiment, each slot of the plurality of slots is oriented either +45 degrees or −45 degrees relative to the cylindrical feed wave impinging at a central location of each slot, such that the slotted array includes a first set of slots rotated +45 degrees relative to the cylindrical feed wave propagation direction from a center feed and a second set of slots rotated −45 degrees relative to the propagation direction of the cylindrical feed wave from the center feed. In one embodiment, adjacent elements for the same frequency band are oriented differently and oppositely.

In one embodiment, each slotted array comprises a plurality of slots and a plurality of patches, wherein each of the patches is co-located over and separated from a slot in the plurality of slots, thereby forming a patch/slot pair, and each patch/slot pair is turned off or on based on application of a voltage to the patch in the pair. A controller is coupled to the slotted array and applies a control pattern that controls which patch/slot pairs are on and off, thereby causing generation of a beam according to a holographic interference principle.

The following discussion describes various types of interleaving schemes shown for two types of antennas, one combined interleaved dual receive antenna (e.g., Ka-band Rx and Ku-band Rx) and one combined interleaved dual Tx/Rx antenna operating at the Ku-band.

FIG. 1 illustrates one embodiment of a dual reception antenna showing received antenna elements. In this embodiment, the dual receive antenna is a Ku receive-Ka receive antenna. Referring to FIG. 1, a slotted array of Ku antenna elements is shown. A number of Ku antenna elements are shown either off or on. For example, the aperture shows Ku on element 101 and Ku off element 102. Also shown in the aperture layout is center feed 103. Also, as shown, in one embodiment, the Ku antenna elements are positioned or located in circular rings around center feed 103 and each includes a slot with a patch co-located over the slot. In one embodiment, each of the slot slots is oriented either +45 degrees or −45 degrees relative to the cylindrical feed wave emanating from center feed 103 and impinging at a central location of each slot.

Figure 2:
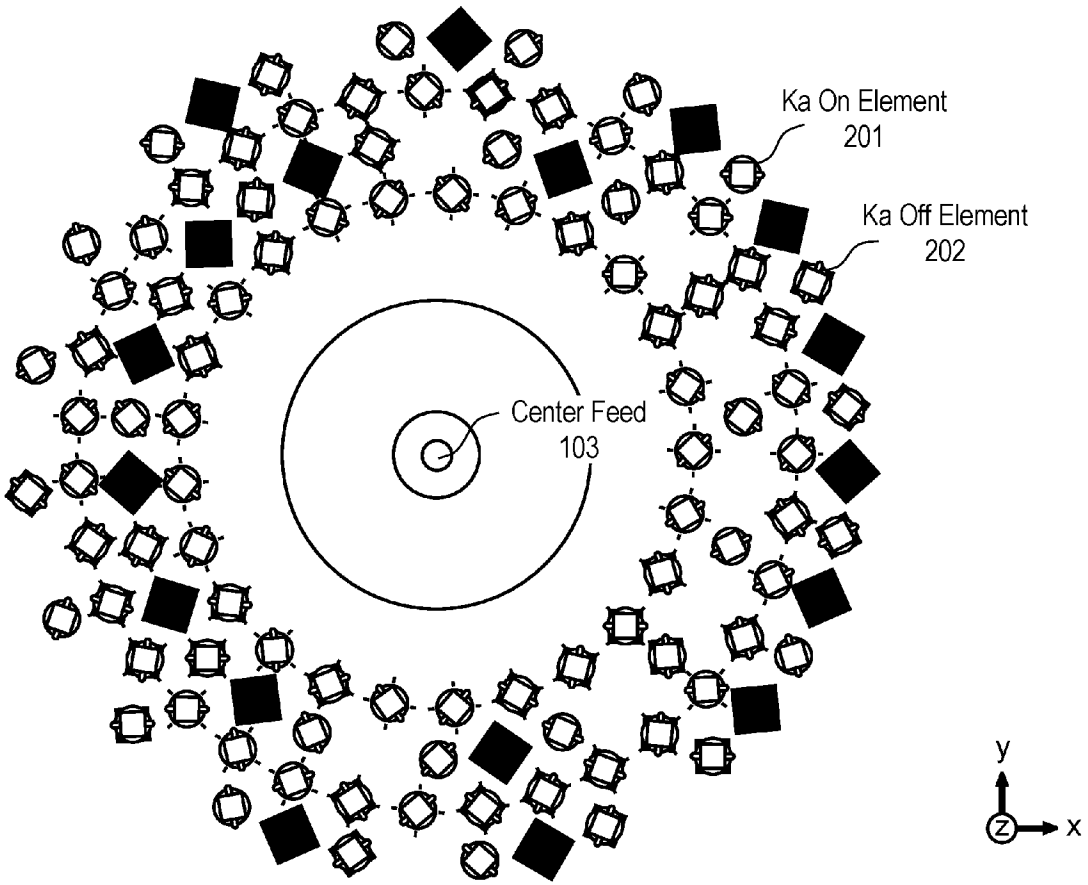
FIG. 2 illustrates a dual receive antenna of FIG. 1 showing the Ka-band receive elements either on or off.

FIG. 2 illustrates the dual receive antenna of FIG. 1 showing the Ka receive elements either on or off. Referring to FIG. 2, for example, Ka element 201 is shown as on, and Ka element 202 is shown as off. As with the Ka antenna elements, in one embodiment, the Ka antenna elements are positioned or located in circular rings around center feed 103 and each includes a slot with a patch co-located over the slot. In one embodiment, each of the slots is oriented either +45 degrees or −45 degrees relative to the cylindrical feed wave emanating from center feed 103 and impinging at a central location of each slot.

In one embodiment, the density of the Ku elements adheres to the λ/4 or λ/5 spacing with respect to each other, while the density of Ka elements is slightly greater for the Ka elements, but the elements are placed around the Ku elements so the spacing is irregular.

In one embodiment, the number of Ka elements in FIG. 2 is larger than the number of Ku receive elements shown in FIG. 1, while the size of the Ku antenna elements is greater than the Ka antenna elements. In one embodiment, there are nearly three times as many Ka elements as Ku elements. This increased density and smaller size of the Ka elements is due to the difference in frequencies associated with the Ka and Ku bands. Typically, the elements for the higher frequency will be higher in number than the elements for the lower frequency. The ideal number of Ka elements would be 2.85 times the number of Ku elements based on a ratio of the frequencies of the two bands (i.e., (20/11.85)^2 equals 2.85). Thus, the ideal packing ratio is 2.85:1.

Note that in FIGS. 1 and 2, the number of antenna elements shown is only an example. The actual number of antenna elements is generally going to be much greater in number. For example, in one embodiment, an antenna aperture with a diameter of 70 cm has about 28,500 Ka receive elements and about 10,000 Ku receive elements.

Figure 3:
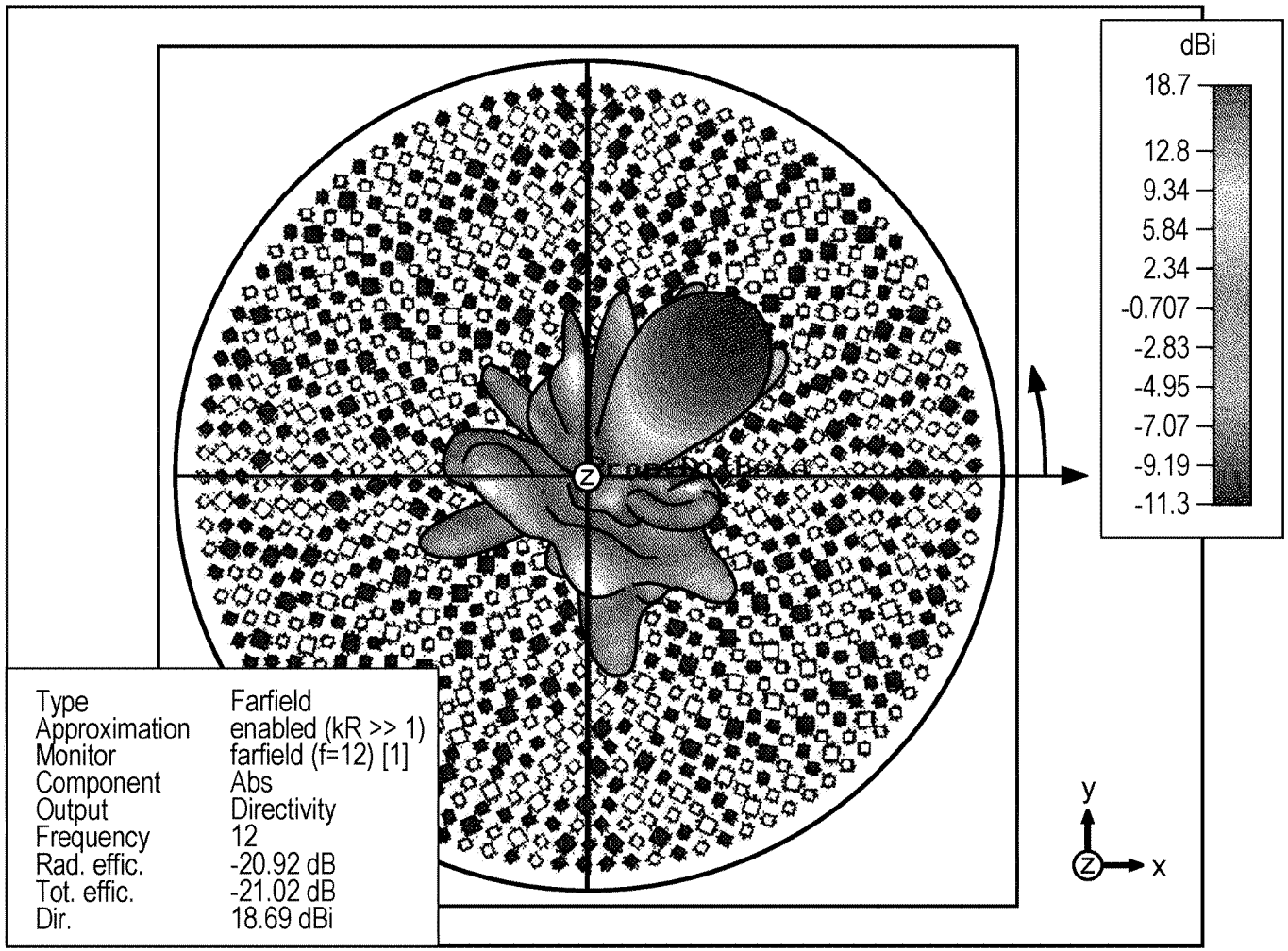
FIG. 3 illustrates the full antenna shown with modeled Ku-band performance on a 30 dB scale.
Figure 4:
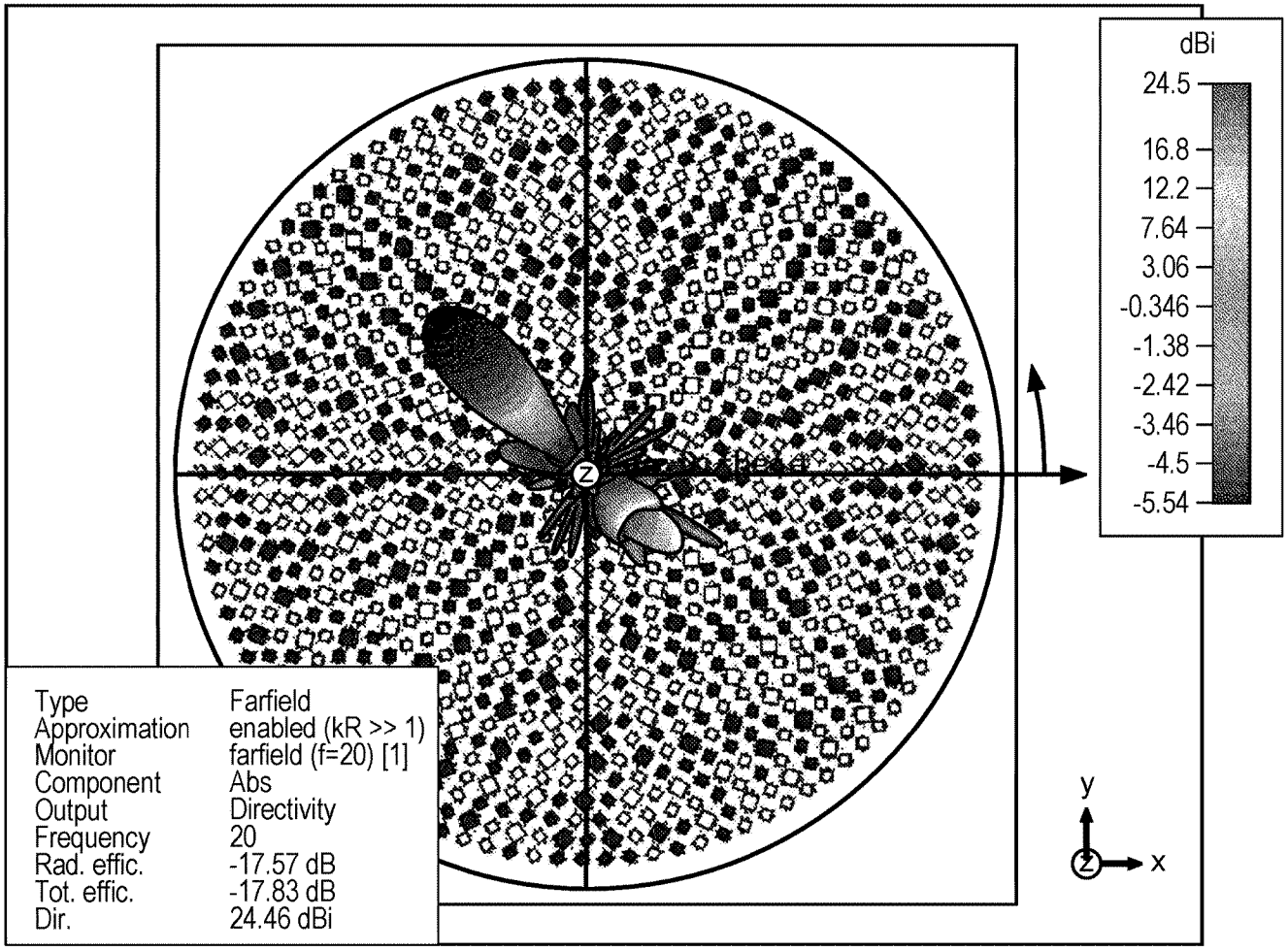
FIG. 4 illustrates the full antenna shown with modeled Ka-band performance on a 30 dB scale.

FIG. 3 illustrates the full antenna shown with modeled Ku performance on a 30 dB scale. FIG. 4 illustrates the full antenna shown with modeled Ka performance on a 30 dB scale.

Figure 5B:
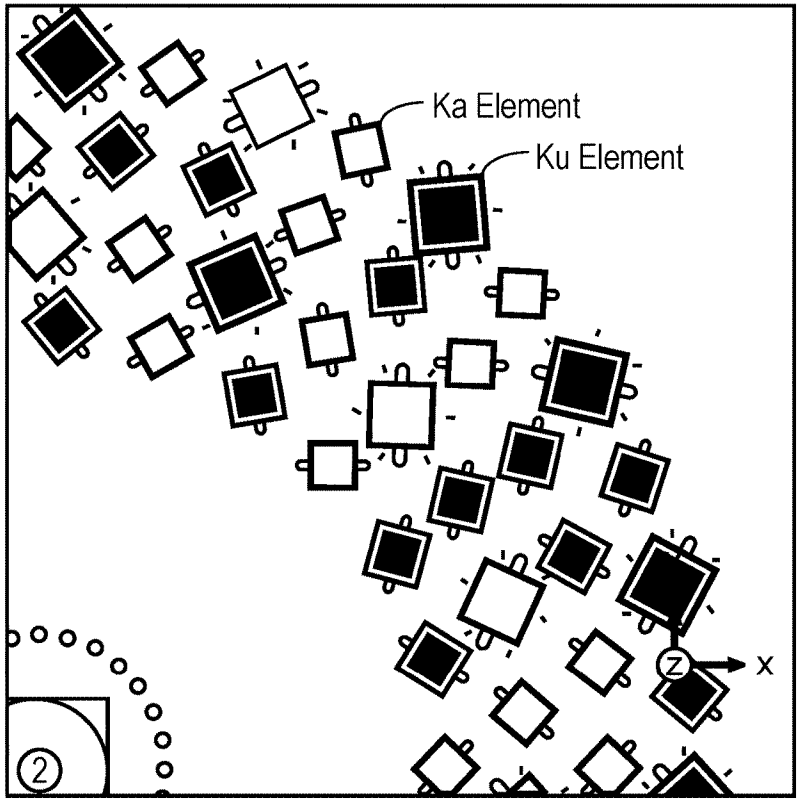
FIGS. 5A and 5B illustrate one embodiment of an interleaved layout of the dual Ku-Ka-bands reception antenna shown in FIGS. 1 and 2.
Figure 5A:
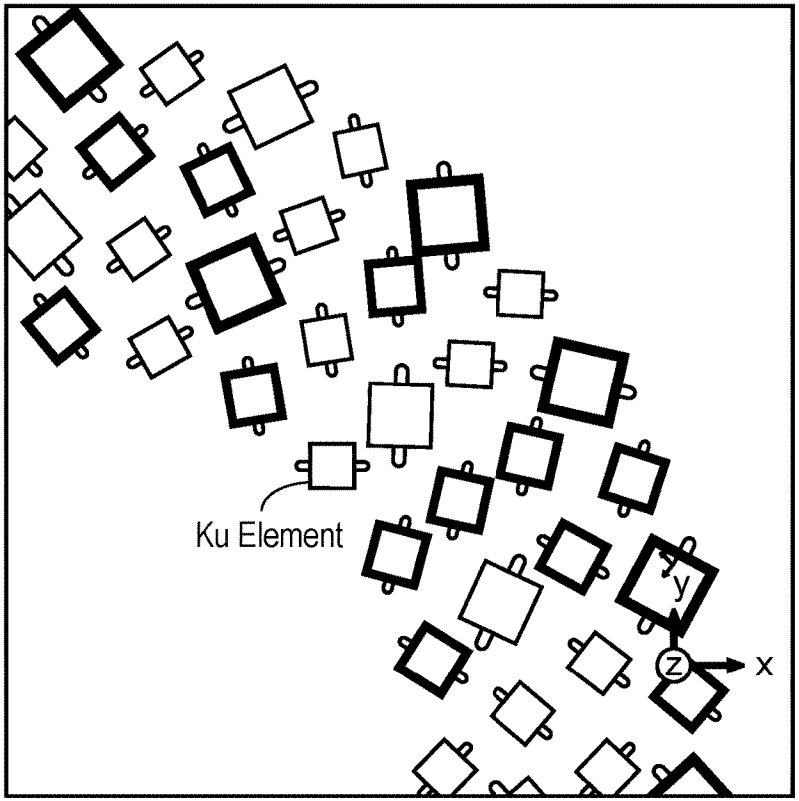

FIGS. 5A and 5B illustrate one embodiment of an interleaved layout of the dual Ku-Ka reception antenna shown in FIGS. 1 and 2.

Figure 6:
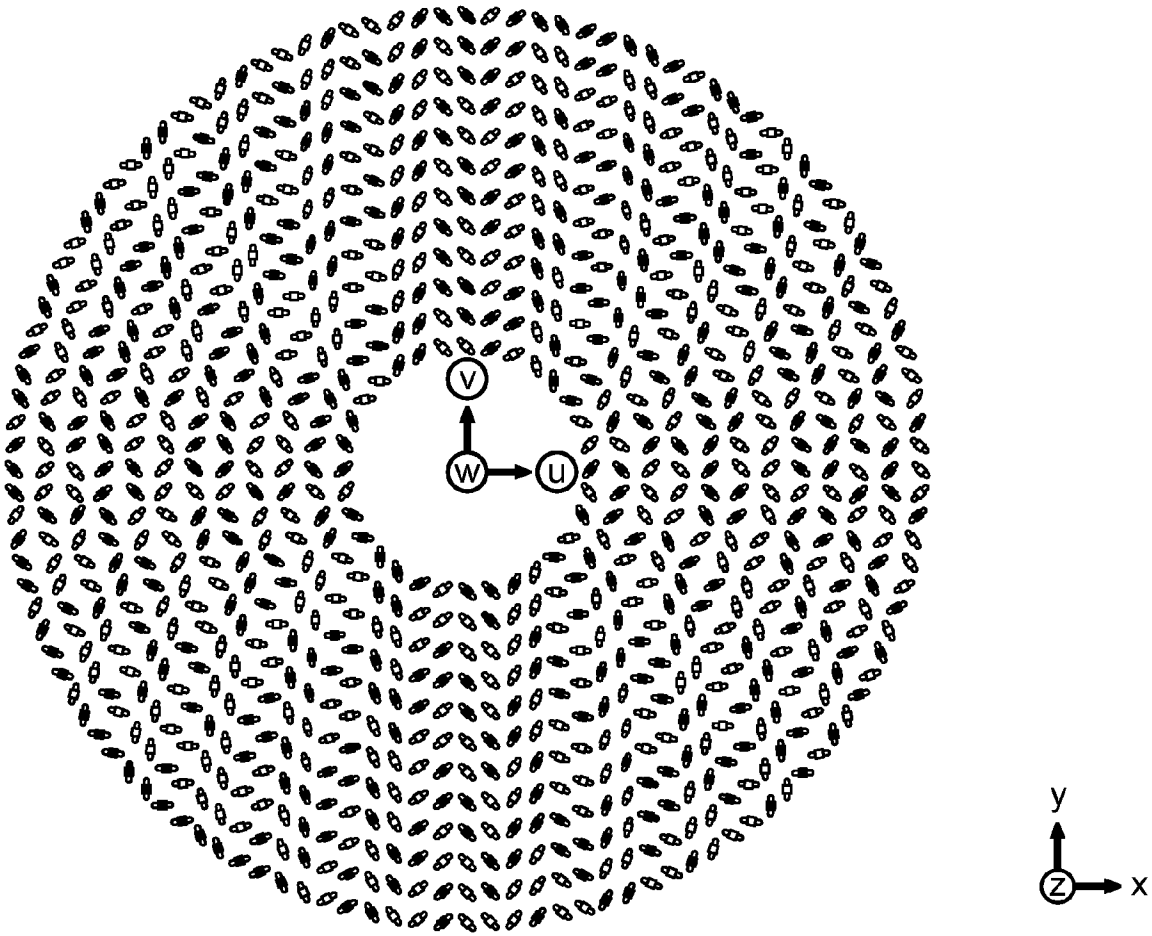
FIG. 6 illustrates one embodiment of a combined aperture with both transmit and receive antenna elements.
Figure 7:
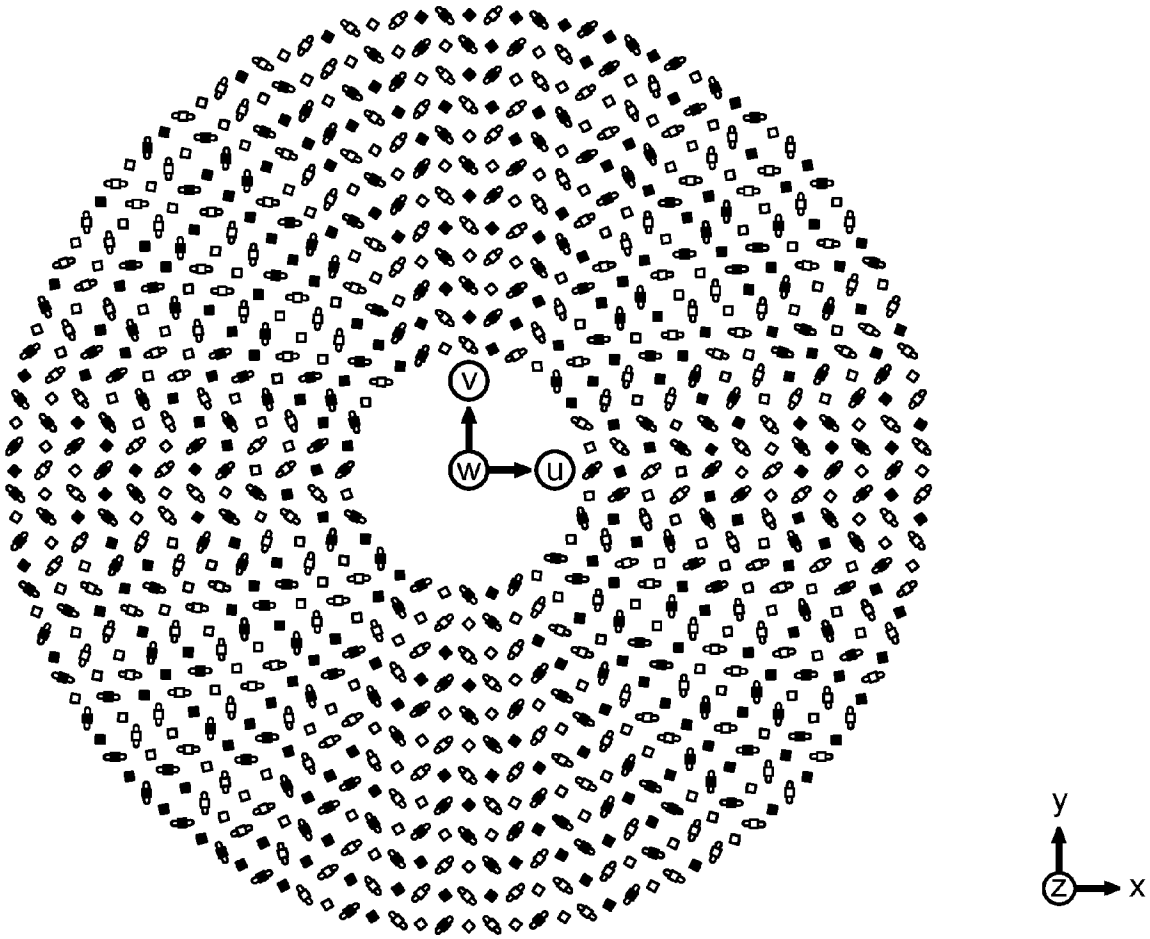
FIG. 7 illustrates one embodiment of the Ku-band receive elements of the antenna in FIG. 6.
Figure 8:
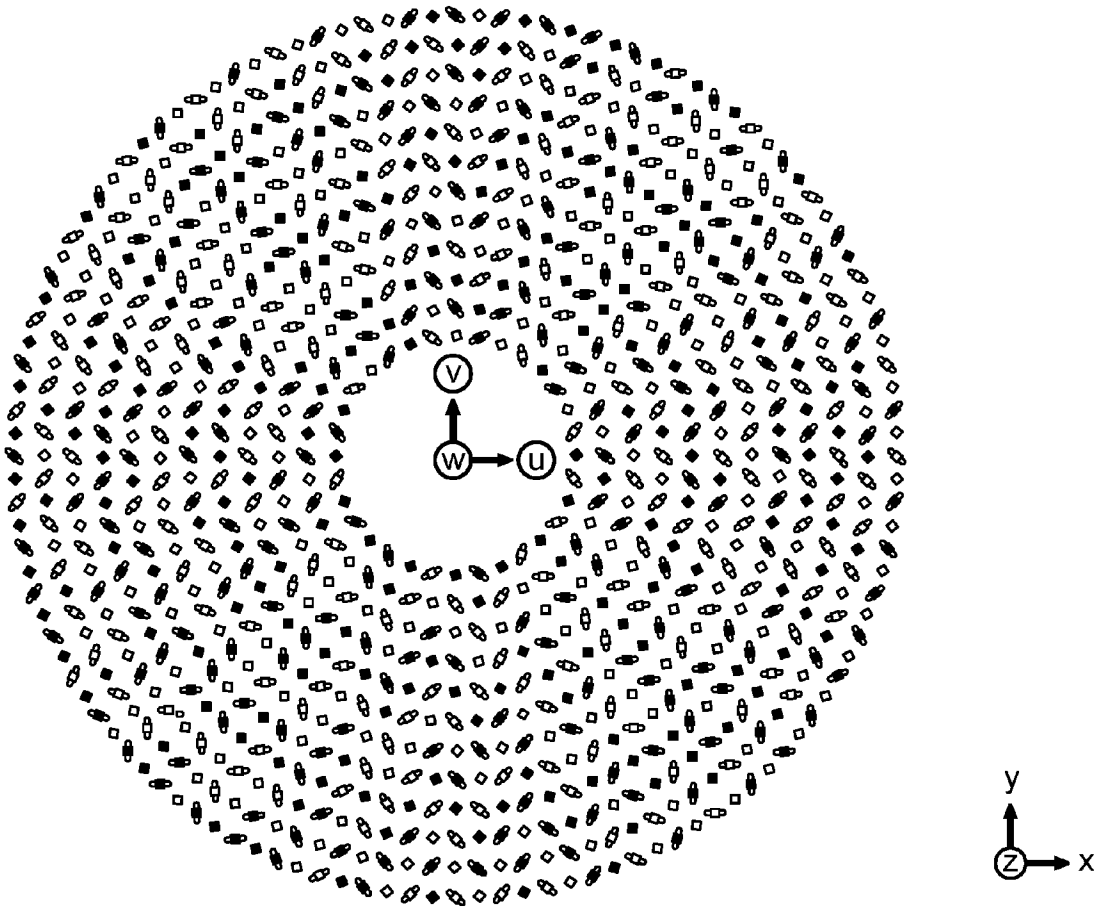
FIG. 8 illustrates one embodiment of the Ku-band transmit elements of the antenna in FIG. 6.

FIG. 6 illustrates one embodiment of a combined aperture with both transmit and receive antenna elements. In this embodiment, the combined aperture is for a dual transmit and receive Ku band antenna. FIG. 7 illustrates one embodiment of the Ku receive elements of the antenna in FIG. 6. FIG. 8 illustrates one embodiment of the Ku transmit elements of the antenna in FIG. 6.

Referring to FIG. 6, the two slotted arrays of Ku antenna elements are shown, with a number of Ku antenna elements being shown as either off or on. Also shown is in the aperture layout is a center feed. Also, as shown, in one embodiment, the Ku antenna elements are positioned or located in circular rings around the center feed and each includes a slot with a patch co-located over the slot. In one embodiment, each of the slots is oriented either +45 degrees or −45 degrees relative to the direction of propagation of the cylindrical feed wave emanating from the center feed and impinging at a central location of each slot.

Referring to FIG. 7, the Ku receive elements are shown as either on or off. In one embodiment, the Ku receive antenna elements are positioned or located in circular rings around the center feed and each includes a slot with a patch co-located over the slot. In one embodiment, each of the slot slots is oriented either +45 degrees or −45 degrees relative to the direction of propagation of the cylindrical feed wave emanating from the center feed and impinging at a central location of each slot.

Referring to FIG. 8, the Ku transmit elements are shown as either on or off. In one embodiment, the Ku transmit antenna elements are positioned or located in circular rings around the center feed and each includes a slot with a patch co-located over the slot. In one embodiment, each of the slot slots is oriented either +45 degrees or −45 degrees relative to the direction of propagation of the cylindrical feed wave emanating from the center feed and impinging at a central location of each slot.

In one embodiment, the densities of both the Ku receive elements and the Ku transmit elements adheres to the λ/4 or λ/5 spacing with respect to each other. Other spacings may be used (e.g., λ/6.3). In one embodiment, the number of Ku receive elements in FIG. 7 is smaller than the number of Ku transmit elements shown in FIG. 8, while the size of the Ku receive antenna elements is greater than the Ku transmit antenna elements. This increased density and smaller size of the Ku transmit antenna elements is due to the difference in frequencies associated with the Ku transmit and receive bands (i.e., 14 GHz and 12 GHz, respectively). In one embodiment, because the frequencies are close to each other, the two interleaved slotted arrays have the same number of antenna elements. Thus, the packing ratio is 1:1.

The amount of frequency separation that is required to interleave 2 elements is based on element design (specifically Q-response), feed design, system level implementations such as, for example, a diplexer's filtering response that dictates isolation, and finally the satellite network, which sets requirements for the carrier/noise ratio (C/N) and other similar link specifications. The two frequencies, 12 GHz and 14 GHz, operate simultaneously from an antenna design perspective, which is a 15% bandwidth separation.

Note that in FIGS. 6-8, the number of antenna elements shown is only an example. The actual number of antenna elements is generally going to be much greater in number. For example, in one embodiment, a 70 cm aperture has about 14,000 receive elements and 14,000 transmit elements. Also, while the antenna elements may be positioned in rings, this is not a requirement. They may be positioned in other arrangements (e.g., arranged in grids).

Figure 9:
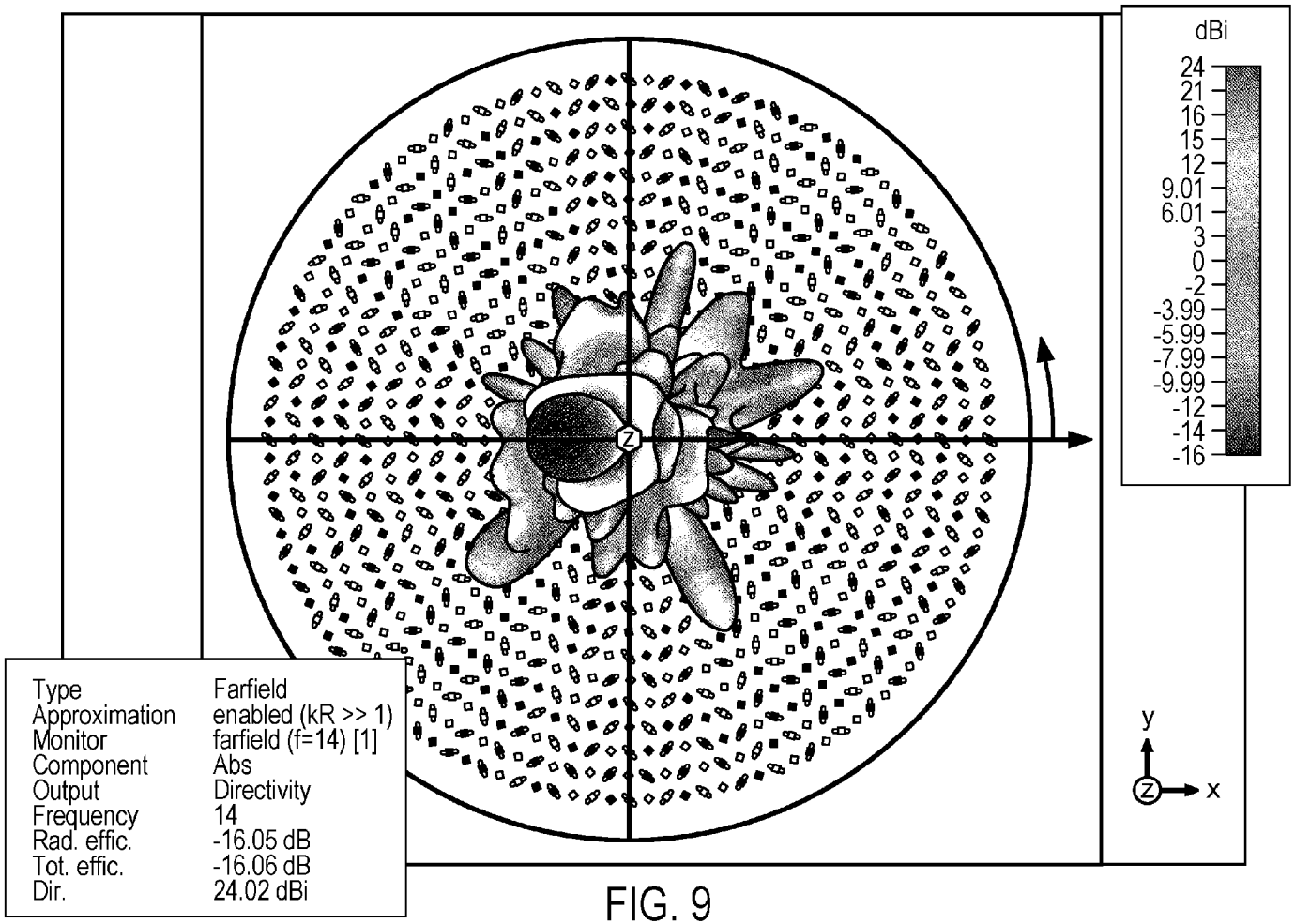
FIG. 9 illustrates one embodiment of the Ku-band transmit elements modeled Ku-band performance on a 40 dB scale.
Figure 10:
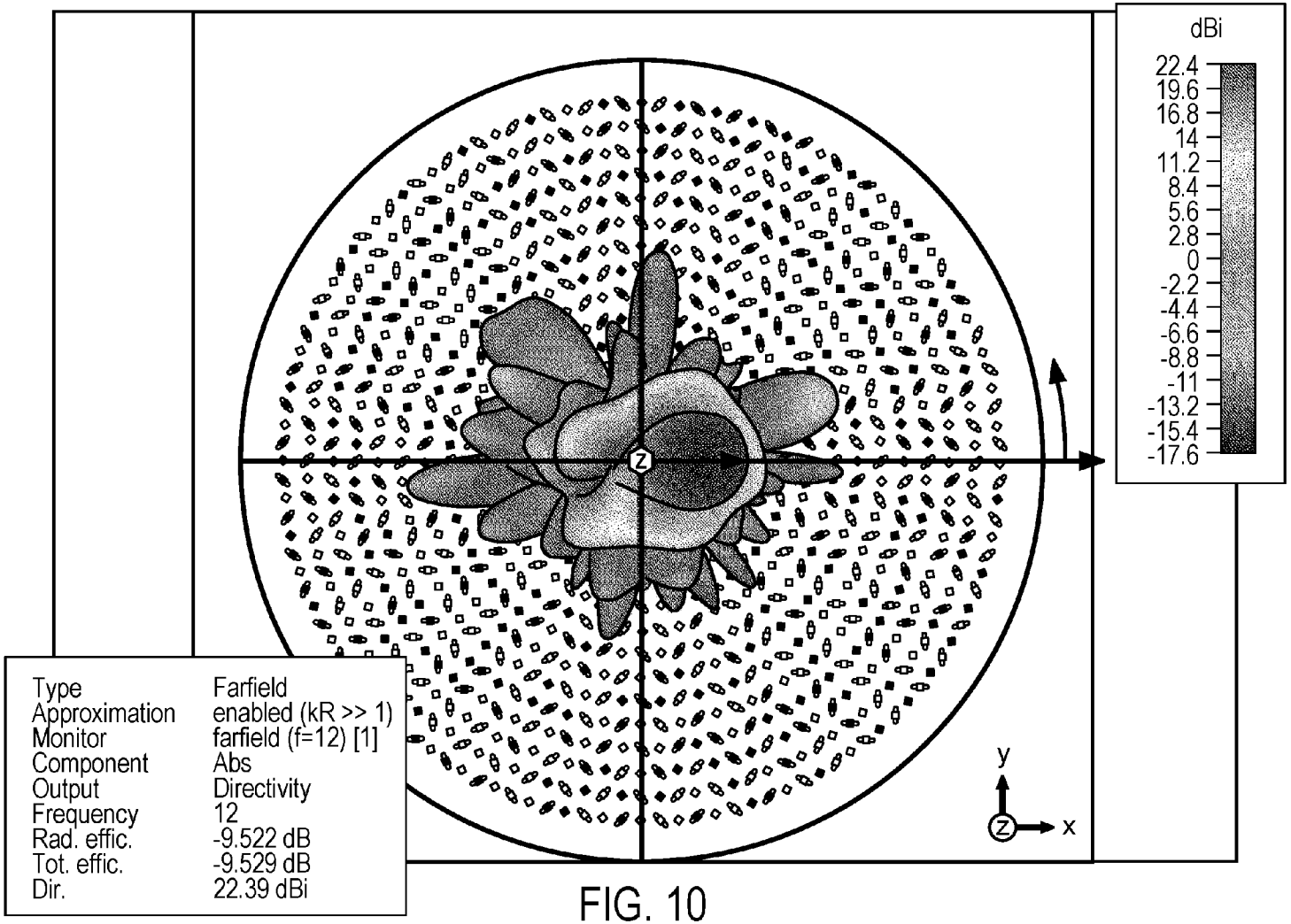
FIG. 10 illustrates one embodiment of the Ku-band receive elements modeled on a 40 dB scale.

FIG. 9 illustrates one embodiment of the Ku transmit elements modeled Ku performance on a 40 dB scale. FIG. 10 illustrates one embodiment of the Ku receive elements modeled on a 40 dB scale.

While specific frequencies are identified with the example embodiments discussed above, various combinations of transmit and receive, dual band transmit, dual band receive, etc., can all be designed to operate at selectable frequencies.

Note that the combined aperture techniques described herein are not limited to small angular difference pointing angles in the same fundamental way that dishes having combined feeds are. This is because the approach to interleaving to create the combined physical aperture results in two independent, but spatially interleaved (or combined), apertures whose pointing angle is completely independent. The pointing limitations are those of flat panel metamaterial antennas, which are demonstrated to point beyond 60 degrees off bore sight, and cover the full 360 degrees in azimuth, forming approximately a 120 deg×360 deg pointing cone.

With the techniques described herein, dual, triple, or even greater aperture combination through interleaving apertures are also possible.

Advantages of embodiments of the present invention include the following. One advantage is to increase data through-put through a given antenna area. For communication systems requiring simultaneous 2-way, multi-band, or multi-satellite links, this is an enabling technology. The advantages of this interleaving/combining approach become most obvious when liquid crystal display (LCD) technology is used to fabricate the antenna panels. This is because the driving switches can then be TFT's (thin film transistors), which are smaller than surface mount field effect transistors (FET) drivers, allowing for higher density interleaving. Note that the element density is still much less than the pixel density achieved by LCD manufacturers.

Figure 15:
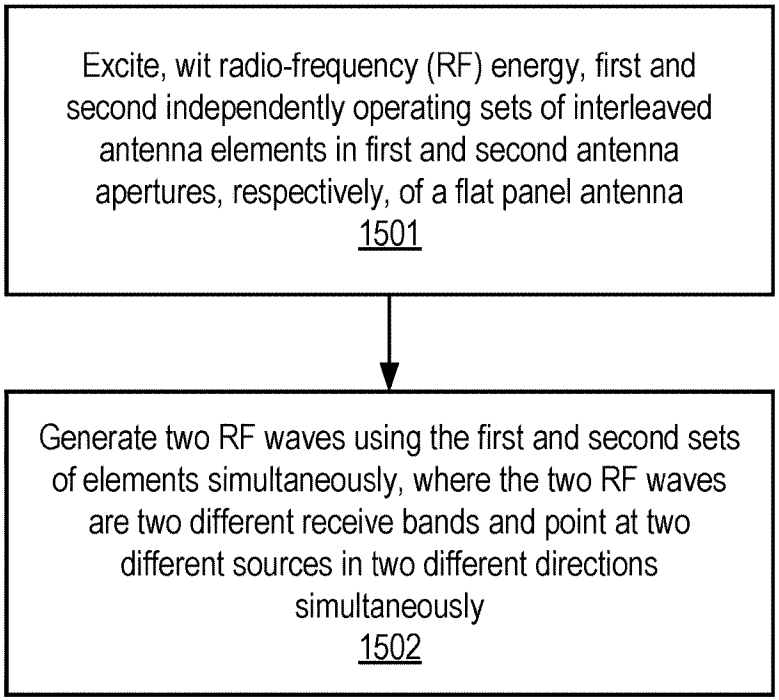
FIG. 15 is a flow diagram of one embodiment of a process for simultaneous multiple antenna operation.

FIG. 15 is a flow diagram of one embodiment of a process for simultaneous multiple antenna operation. The process is performed by processing logic that may comprise hardware (circuitry, dedicated logic, etc.), software (such as is run on a general purpose computer system or a dedicated machine), or a combination of both.

Referring to FIG. 15, the process begins by exciting, with radio-frequency (RF) energy, first and second independently operating sets of interleaved antenna elements in first and second antenna arrays, respectively, of a flat panel antenna (processing block 1501). In receive mode, one of the arrays is excited by a transmitted RF wave.

Next, processing logic generates two farfield patterns from the first and second sets of elements simultaneously, where the two farfield patterns operate in two different receive bands and point at two different sources in two different directions simultaneously, with the first and second independently operating sets of interleaved antenna elements in the first and second antenna arrays (processing block 1502).

In another embodiment, one of the sets of elements is excited by an RF wave being transmitted, thereby forming a beam using these elements, while another set of elements is excited by RF signals being received. In this manner, the antenna is used for the transmission and reception at the same time.

Antenna Elements

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is disposed in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

Reducing the thickness of the LC increases the beam switching speed. A fifty percent (50%) reduction in the gap between the lower and the upper conductor (the thickness of the liquid crystal channel) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

In one embodiment, the feed geometry of this antenna system allows the antenna elements to be positioned at forty five degree (45°) angles to the vector of the wave in the wave feed. This position of the elements enables control of the free space wave received by or generated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides as described above.

The elements are turned off or on by applying a voltage to the patch using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage above which an increase of the voltage does not cause major tuning in liquid crystal. These two characteristic parameters can change for different liquid crystal mixtures.

In one embodiment, a matrix drive is used to apply voltage to the patches in order to drive each cell separately from all the other cells without having a separate connection for each cell (direct drive). Because of the high density of elements, the matrix drive is the most efficient way to address each cell individually.

The control structure for the antenna system has 2 main components; the controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude of an AC bias signal to that element.

In one embodiment, the controller also contains a microprocessor executing the software. The control structure may also incorporate sensors (e.g., a GPS receiver, a three axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the controller controls which elements are turned off and those elements turned on at the frequency of operation. The elements are selectively detuned for frequency operation by voltage application.

For transmission, a controller supplies an array of voltage signals to the RF patches to create a modulation, or control pattern. The control pattern causes the elements to be turned on or off. In one embodiment, multistate control is used in which various elements are turned on and off to varying levels, further approximating a sinusoidal control pattern, as opposed to a square wave (i.e., a sinusoid gray shade modulation pattern). Some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the beam pointing angle for both interleaved antennas is defined by the modulation, or control pattern specifying which elements are on or off. In other words, the control pattern used to point the beam in the desired way is dependent upon the frequency of operation.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 11A:
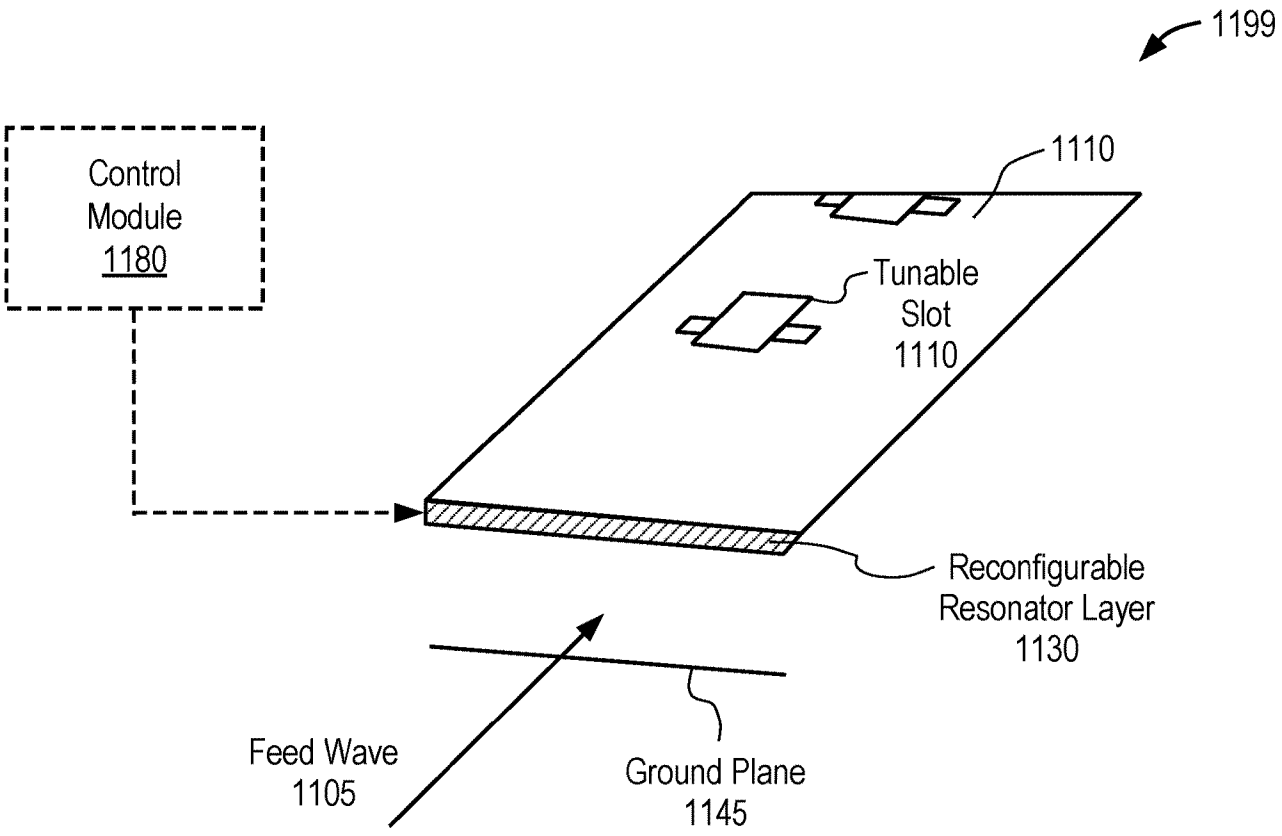
FIG. 11A illustrates a perspective view of one row of antenna elements that includes a ground plane and a reconfigurable resonator layer.

FIG. 11A illustrates a perspective view of one row of antenna elements that includes a ground plane and a reconfigurable resonator layer. Reconfigurable resonator layer 1130 includes an array of tunable slots 1110. The array of tunable slots 1110 can be configured to point the antenna in a desired direction. Each of the tunable slots can be tuned/adjusted by varying a voltage across the liquid crystal.

Control module 1180 is coupled to reconfigurable resonator layer 1130 to modulate the array of tunable slots 1110 by varying the voltage across the liquid crystal in FIG. 11A. Control module 1180 may include a Field Programmable Gate Array ("FPGA"), a microprocessor, or other processing logic. In one embodiment, control module 1180 includes logic circuitry (e.g., multiplexer) to drive the array of tunable slots 1110. In one embodiment, control module 1180 receives data that includes specifications for a holographic diffraction pattern to be driven onto the array of tunable slots 1110. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1180 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1105 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1110 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w_{in}*w_{out}$, with $w_{in}$ as the wave equation in the waveguide and $w_{out}$ the wave equation on the outgoing wave.

Figure 11B:
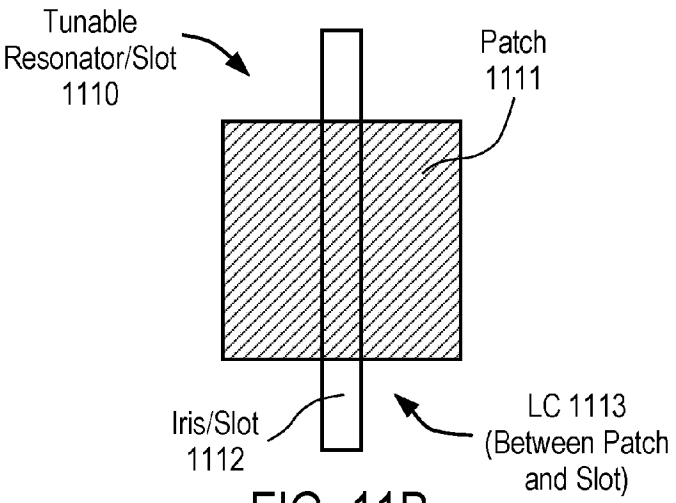
FIG. 11B illustrates one embodiment of a tunable resonator/slot.

FIG. 11B illustrates a tunable resonator/slot 1110, in accordance with an embodiment of the disclosure. Tunable slot 1110 includes an iris/slot 1112, a radiating patch 1111, and liquid crystal 1113 disposed between iris 1112 and patch 1111. In one embodiment, radiating patch 1111 is co-located with iris 1112.

Figure 11C:
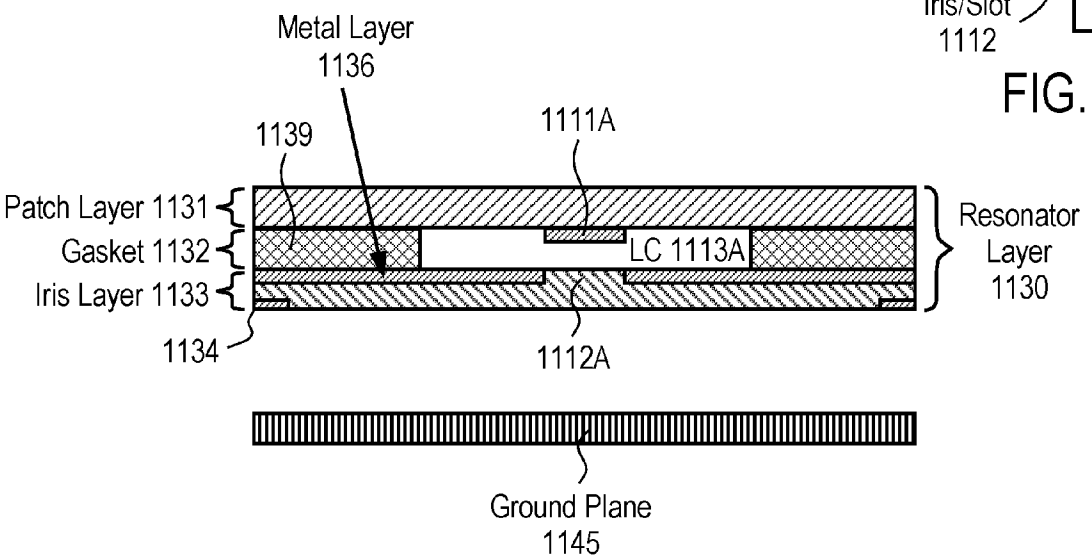
FIG. 11C illustrates a cross section view of one embodiment of an antenna structure.

FIG. 11C illustrates a cross section view of a physical antenna aperture, in accordance with an embodiment of the disclosure. The antenna aperture includes ground plane 1145, and a metal layer 1136 within iris layer 1133, which is included in reconfigurable resonator layer 1130. Iris/slot 1112 is defined by openings in metal layer 1136. Feed wave 1105 may have a microwave frequency compatible with satellite communication channels. Feed wave 1105 propagates between ground plane 1145 and resonator layer 1130.

Reconfigurable resonator layer 1130 also includes gasket layer 1132 and patch layer 1131. Gasket layer 1132 is disposed between patch layer 1131 and iris layer 1133. Note that in one embodiment, a spacer could replace gasket layer 1132. Iris layer 1133 may be a printed circuit board ("PCB") that includes a copper layer as metal layer 1136. Openings may be etched in the copper layer to form slots 1112. In one embodiment, iris layer 1133 is conductively coupled by conductive bonding layer 1134 to another structure (e.g., a waveguide), in FIG. 11C. Note that in an embodiment such as shown in FIG. 8 the iris layer is not conductively coupled by a conductive bonding layer and is instead interfaced with a non-conducting bonding layer.

Patch layer 1131 may also be a PCB that includes metal as radiating patches 1111. In one embodiment, gasket layer 1132 includes spacers 1139 that provide a mechanical stand-off to define the dimension between metal layer 1136 and patch 1111. In one embodiment, the spacers are 75 microns, but other sizes may be used (e.g., 3-200 mm). Tunable resonator/slot 1110 includes patch 1111, liquid crystal 1113, and iris 1112. The chamber for liquid crystal 1113 is defined by spacers 1139, iris layer 1133 and metal layer 1136. When the chamber is filled with liquid crystal, patch layer 1131 can be laminated onto spacers 1139 to seal liquid crystal within resonator layer 1130.

A voltage between patch layer 1131 and iris layer 1133 can be modulated to tune the liquid crystal in the gap between the patch and the slots 1110. Adjusting the voltage across liquid crystal 1113 varies the capacitance of slot 1110. Accordingly, the reactance of slot 1110 can be varied by changing the capacitance. Resonant frequency of slot 1110 also changes according to the equation $$f = \frac{1}{2\pi\sqrt{LC}}$$

where f is the resonant frequency of slot 1110 and L and C are the inductance and capacitance of slot 1110, respectively. The resonant frequency of slot 1110 affects the energy radiated from feed wave 1105 propagating through the waveguide. As an example, if feed wave 1105 is 20 GHz, the resonant frequency of a slot 1110 may be adjusted (by varying the capacitance) to 17 GHz so that the slot 1110 couples substantially no energy from feed wave 1105. Or, the resonant frequency of a slot 1110 may be adjusted to 20 GHz so that the slot 1110 couples energy from feed wave 1105 and radiates that energy into free space. Although the examples given are binary (fully radiating or not radiating at all), full grey scale control of the reactance, and therefore the resonant frequency of slot 1110 is possible with voltage variance over a multi-valued range. Hence, the energy radiated from each slot 1110 can be finely controlled so that detailed holographic diffraction patterns can be formed by the array of tunable slots.

In one embodiment, tunable slots in a row are spaced from each other by λ/5. Other spacings may be used. In one embodiment, each tunable slot in a row is spaced from the closest tunable slot in an adjacent row by λ/2, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments of this invention use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015, to the multi-aperture needs of the marketplace.

Figures 12A, 12B, 12C, 12D:
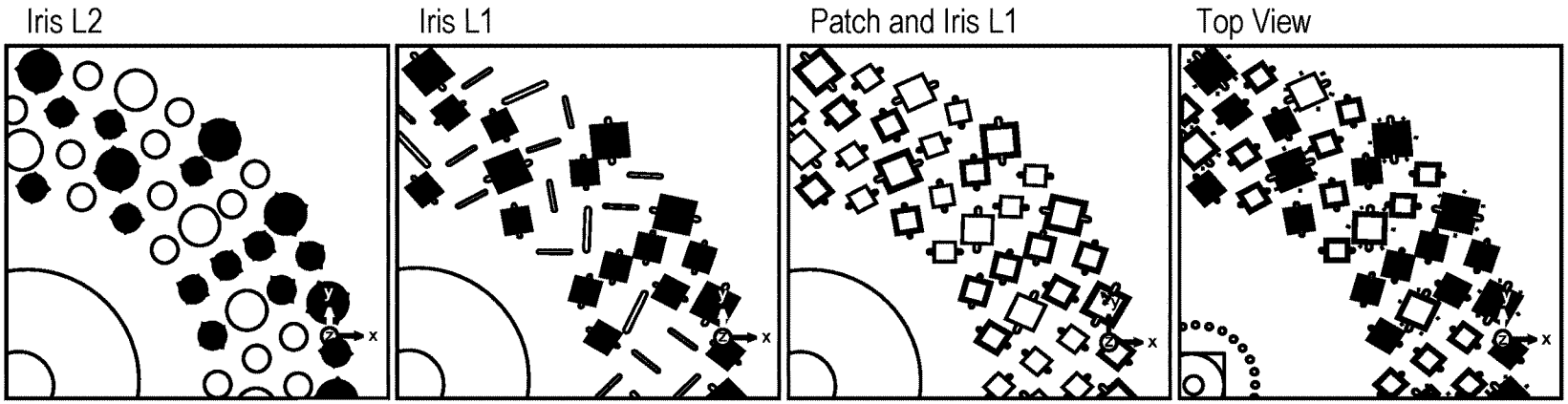
FIGS. 12A-D illustrate one embodiment of the different layers for creating the slotted array.

FIGS. 12A-D illustrate one embodiment of the different layers for creating the slotted array. FIG. 12A illustrates the first iris board layer with locations corresponding to the slots. Referring to FIG. 12A, the circles are open areas/slots in the metallization in the bottom side of the iris substrate/glass, which is for controlling the coupling of elements to the feed (the feed wave). Note that this layer is an optional layer and is not used in all designs. FIG. 12B illustrates the second iris board layer containing slots. FIG. 12C illustrates patches over the second iris board layer. FIG. 12D illustrates a top view of the slotted array.

Figure 13:
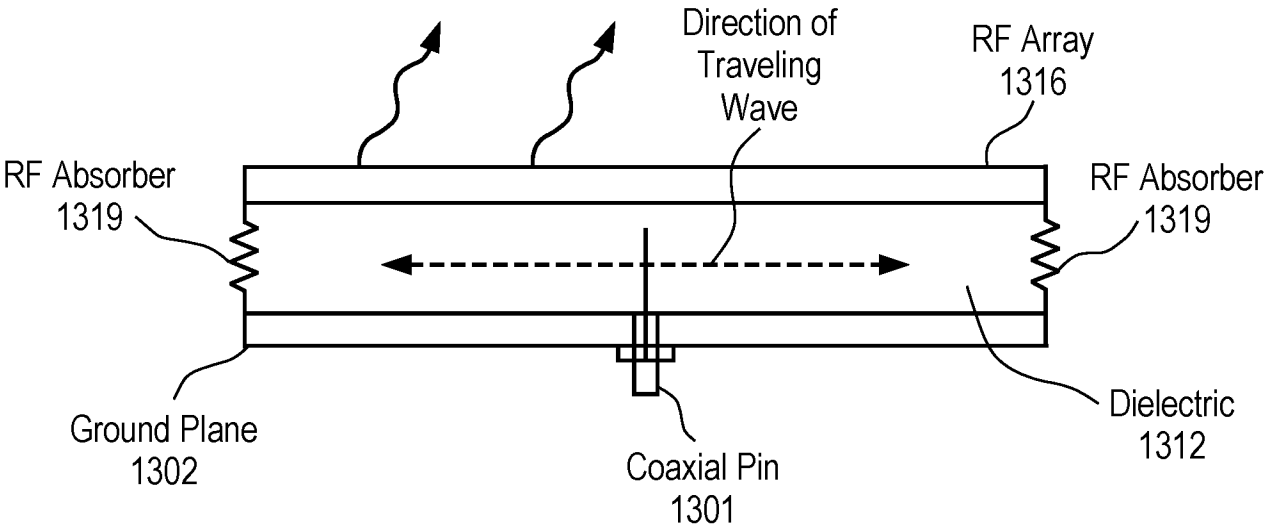
FIG. 13 illustrates a side view of one embodiment of a cylindrically fed antenna structure.

FIG. 13 illustrates another embodiment of the antenna system with an outgoing wave. Referring to FIG. 13, a ground plane 1302 is substantially parallel to an RF array 1316 with a dielectric layer 1312 (e.g., a plastic layer, etc.) in between them. RF absorbers 1319 (e.g., resistors) couple the ground plane 1302 and RF array 1316 together. A coaxial pin 1301 (e.g., 50Ω) feeds the antenna.

In operation, a feed wave is fed through coaxial pin 1315 and travels concentrically outward and interacts with the elements of RF array 1316.

In operation, a feed wave is fed through coaxial pin 1301 and travels concentrically outward and interacts with the elements of RF array 1316.

The cylindrical feed in the antenna of FIG. 13 improves the scan angle of the antenna. Instead of a scan angle of plus or minus forty five degrees azimuth (±45° Az) and plus or minus twenty five degrees elevation (±25° El), in one embodiment, the antenna system has a scan angle of seventy five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

An Example System Embodiment

In one embodiment, the combined antenna apertures are used in a television system that operates in conjunction with a set top box. For example, in the case of a dual reception antenna, satellite signals received by the antenna are provided to a set top box (e.g., a DirecTV receiver) of a television system. More specifically, the combined antenna operation is able to simultaneously receive RF signals at two different frequencies and/or polarizations. That is, one sub-array of elements is controlled to receive RF signals at one frequency and/or polarization, while another sub-array is controlled to receive signals at another, different frequency and/or polarization. These differences in frequency or polarization represent different channels being received by the television system. Similarly, the two antenna arrays can be controlled for two different beam positions to receive channels from two different locations (e.g., two different satellites) to simultaneously receive multiple channels.

Figure 14A:
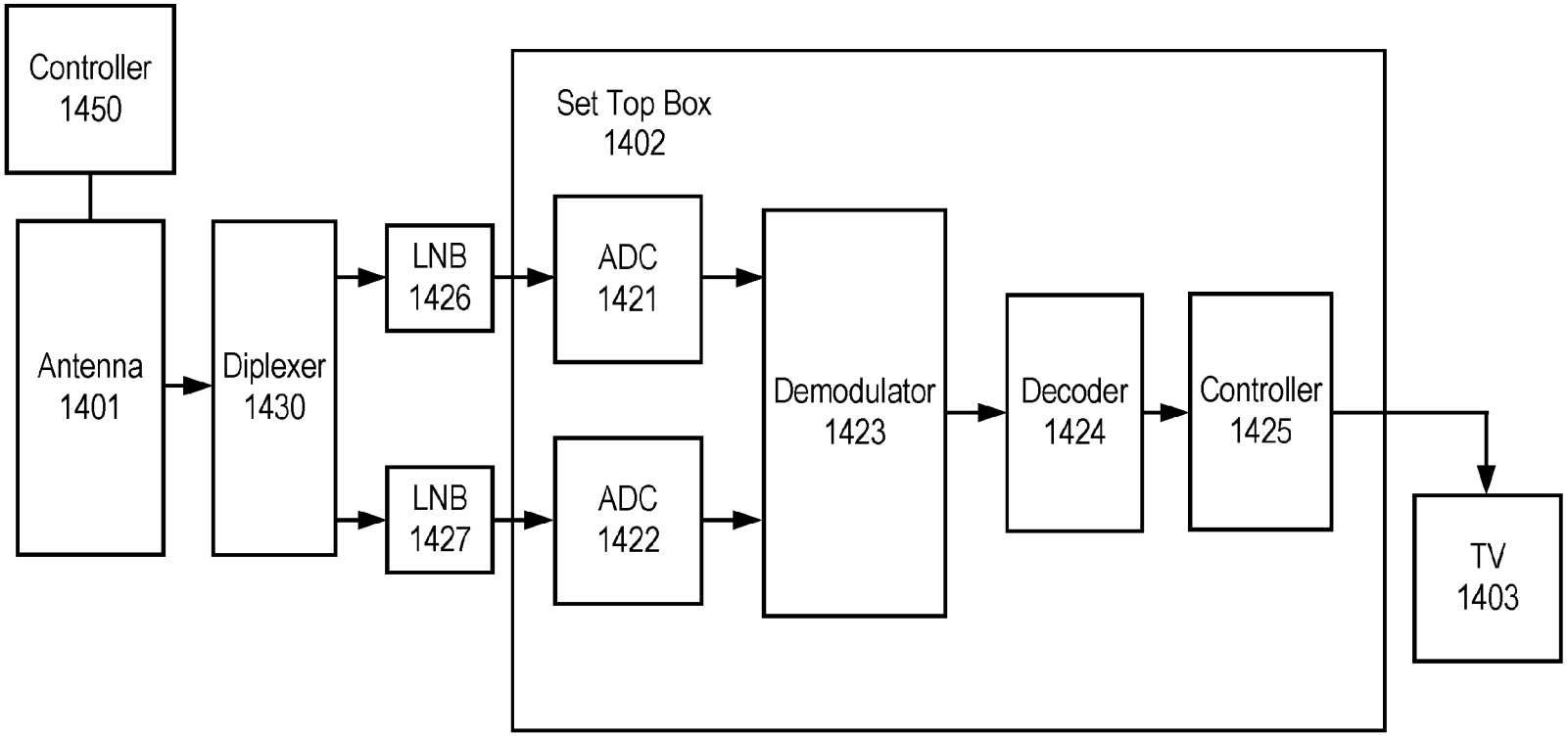
FIG. 14A is a block diagram of one embodiment of a communication system for use in a television system.

FIG. 14A is a block diagram of one embodiment of a communication system that performs dual reception simultaneously in a television system. Referring to FIG. 14A, antenna 1401 includes two spatially interleaved antenna apertures operable independently to perform dual reception simultaneously at different frequencies and/or polarizations as described above. Note that while only two spatially interleaved antenna operations are mentioned, the TV system may have more than two antenna apertures (e.g., 3, 4, 5, etc. antenna apertures).

In one embodiment, antenna 1401, including its two interleaved slotted arrays, is coupled to diplexer 1430. The coupling may include one or more feeding networks that receive the signals from elements of the two slotted arrays to produce two signals that are fed into diplexer 1430. In one embodiment, diplexer 1430 is a commercially available diplexer (e.g., model PB1081WA Ku-band sitcom diplexor from A1 Microwave).

Diplexer 1430 is coupled to a pair of low noise block down converters (LNBs) 1426 and 1427, which perform a noise filtering function, a down conversion function, and amplification in a manner well-known in the art. In one embodiment, LNBs 1426 and 1427 are in an out-door unit (ODU). In another embodiment, LNBs 1426 and 1427 are integrated into the antenna apparatus. LNBs 1426 and 1427 are coupled to a set top box 1402, which is coupled to television 1403.

Set top box 1402 includes a pair of analog-to-digital converters (ADCs) 1421 and 1422, which are coupled to LNBs 1426 and 1427, to convert the two signals output from diplexer 1430 into digital format.

Once converted to digital format, the signals are demodulated by demodulator 1423 and decoded by decoder 1424 to obtain the encoded data on the received waves. The decoded data is then sent to controller 1425, which sends it to television 1403.

Controller 1450 controls antenna 1401, including the interleaved slotted array elements of both antenna apertures on the single combined physical aperture.

An Example of a Full Duplex Communication System

Figure 14B:
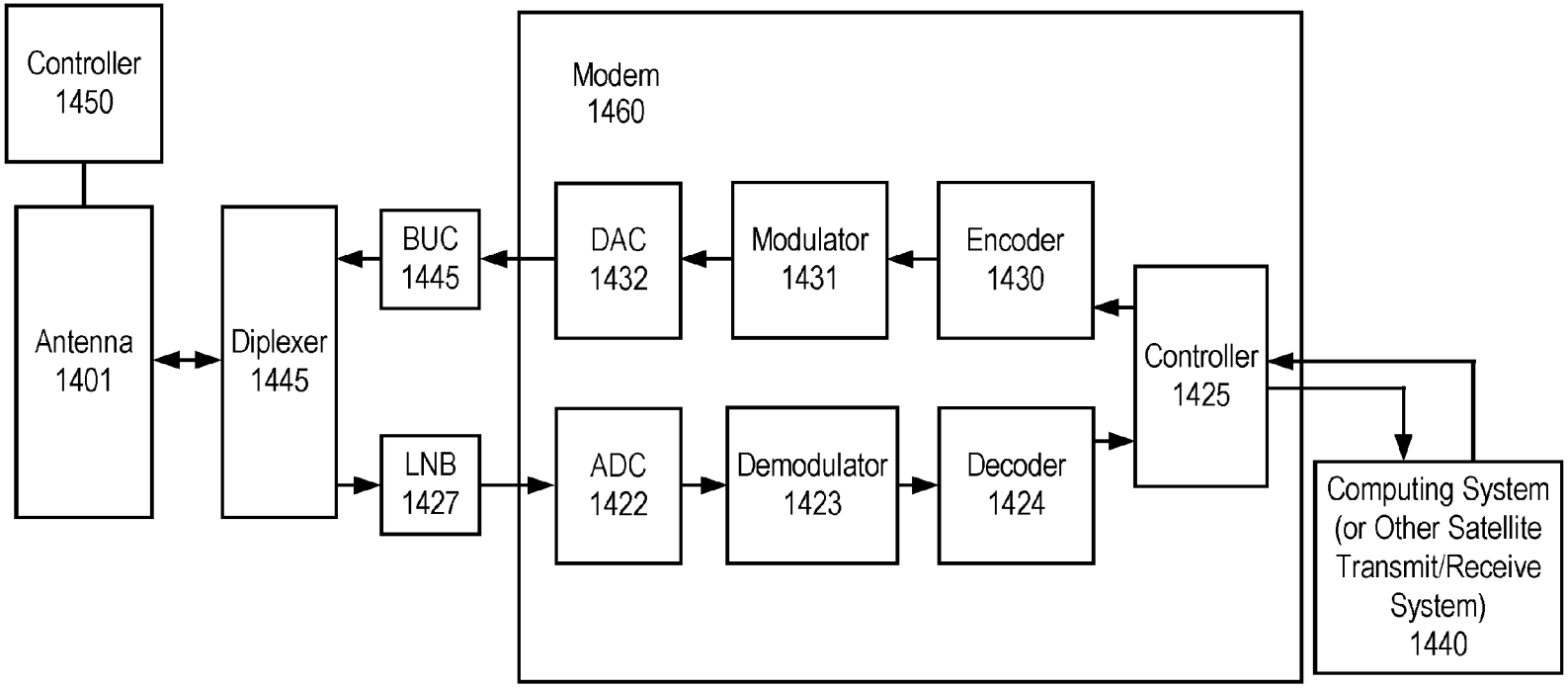
FIG. 14B is a block diagram of another embodiment of a communication system having simultaneous transmit and receive paths.

In another embodiment, the combined antenna apertures are used in a full duplex communication system. FIG. 14B is a block diagram of another embodiment of a communication system having simultaneous transmit and receive paths. While only one transmit path and one receive path are shown, the communication system may include more than one transmit path and/or more than one receive path.

Referring to FIG. 14B, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (up-convert and high pass amplifier) 1433 and provided to one port of diplexer 1433. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

Note that the full duplex communication system shown in FIG. 14B has a number of applications, including but not limited to, internet communication, vehicle communication (including software updating), etc.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An antenna comprising:

a single physical antenna aperture having at least two spatially interleaved antenna sub-arrays of antenna elements, wherein each antenna sub-array is operable independently and simultaneously at a specific frequency, wherein each of the at least two spatially interleaved antenna sub-arrays comprises surface scattering antenna elements and the surface scattering antenna elements of the at least two spatially interleaved antenna sub-arrays are combined into the single physical aperture.

2. The antenna defined in claim 1 wherein pointing angles of the at least two antenna sub-arrays are different such that a first antenna sub-array of the at least two antenna arrays is operable to form a beam in one direction and a second antenna sub-array of the at least two antenna arrays is operable to form a beam in a second direction different than the first direction and that the angle between the two beams is greater than 10°.

3. The antenna defined in claim 1 wherein the at least two antenna sub-arrays comprise combined transmit and receive antenna arrays of antenna elements operable to perform reception and transmission simultaneously.

4. The antenna defined in claim 3 wherein transmission and reception are in the Ku transmit and receive bands, respectively.

5. The antenna defined in claim 1 wherein the at least two antenna sub-arrays comprise combined interleaved dual receive antenna arrays operable to perform reception in two different receive bands and pointing at two different sources in two different directions simultaneously and with switchable/orthogonal polarization states.

6. The antenna defined in claim 5 wherein the two bands comprise the Ka and Ku receive bands.

7. The antenna defined in claim 1 wherein each of the at least two antenna sub-arrays is to operate based on holographic beam forming.

8. The antenna defined in claim 1 wherein each of the at least two antenna sub-arrays comprises a tunable slotted array of antenna elements combined into the single physical aperture.

9. The antenna defined in claim 8 wherein the tunable slotted array for a first of the at least two antenna sub-arrays has a number of elements and element density that is different than that of a second of the at least two antenna sub-arrays.

10. The antenna defined in claim 8 wherein most elements in each of the tunable slots of the at least two antenna sub-arrays are interleaved and spaced with respect to each other.

11. The antenna defined in claim 8 wherein elements in each of the tunable slotted arrays are positioned in one or more rings.

12. The antenna defined in claim 11 wherein one ring of the one or more rings for operation in a first frequency of the multiple frequencies has a different number of elements than one ring of the one or more rings for operation in a second frequency of the multiple frequencies, the first frequency being different than the second frequency.

13. The antenna defined in claim 11 wherein at least one ring has elements of both tunable slotted arrays.

14. The antenna defined in claim 8 wherein each slotted array comprises a plurality of slots and further wherein each slot is tuned to provide a desired scattering at a given frequency.

15. The antenna defined in claim 14 wherein each slot of the plurality of slots is oriented either +45 degrees or −45 degrees relative to the cylindrical feed wave impinging at a central location of each said slot, such that the slotted array includes a first set of slots rotated +45 degrees relative to the cylindrical feed wave propagation direction and a second set of slots rotated −45 degrees relative to the propagation direction of the cylindrical feed wave.

16. The antenna defined in claim 8 wherein each slotted array comprises:

a plurality of slots;

a plurality of patches, wherein each of the patches is co-located over and separated from a slot in the plurality of slots, forming a patch/slot pair, each patch/slot pair being turned off or on based on application of a voltage to the patch in the pair; and a controller that applies a control pattern that controls which patch/slot pairs are on and off, thereby causing generation of a beam.

17. A flat panel antenna comprising:

at least two spatially interleaved antenna sub-arrays combined in a single physical aperture operable independently and simultaneously at distinct frequencies, wherein each of the at least two antenna sub-arrays comprises a tunable slotted array of antenna elements; and a single, radial continuous feed coupled to the aperture[s].

18. The antenna defined in claim 17 wherein pointing angles of the at least two antenna sub-arrays are different such that a first antenna sub-array of the at least two antenna sub-arrays is operable to form a beam in one direction and a second antenna sub-array of the at least two antenna sub-arrays is operable to form a beam in a second direction different than the first direction and that the angle between the two beams is greater than 10 degrees.

19. The antenna defined in claim 17 wherein the at least two antenna sub-arrays comprise combined transmit and receive antenna arrays of antenna elements operable to perform reception and transmission simultaneously.

20. The antenna defined in claim 19 wherein transmission and reception are in the Ku transmit and receive bands, respectively.

21. The antenna defined in claim 17 wherein the at least two antenna sub-arrays comprise combined interleaved dual receive antenna arrays of antenna elements operable to perform reception in two different receive bands and pointing at two different sources in two different directions simultaneously.

22. The antenna defined in claim 21 wherein the two bands comprise the Ka and Ku receive bands.

23. The antenna defined in claim 17 wherein each of the at least two antenna sub-arrays is to operate based on holographic beam forming.

24. The antenna defined in claim 17 wherein the tunable slotted array for a first of the at least two antenna sub-arrays has a number of elements and element density that is different than that of a second of the at least two antenna sub-arrays.

25. The antenna defined in claim 17 wherein most elements in each of the tunable slotted arrays of the at least two antenna sub-arrays are interleaved and spaced with respect to each other.

26. The antenna defined in claim 17 wherein elements in each of the tunable slotted arrays are positioned in one or more rings.

27. The antenna defined in claim 26 wherein one ring of the one or more rings for operation in a first frequency of the multiple frequencies has a different number of elements than one ring of the one or more rings for operation in a second frequency of the multiple frequencies, the first frequency being different than the second frequency.

28. The antenna defined in claim 26 wherein at least one ring has elements of both tunable slotted arrays.

29. A method for transmission comprising:

exciting, with radio-frequency (RF) energy, first and second independently operating sets of interleaved surface scattering antenna elements in first and second antenna sub-arrays, respectively, the sub-arrays being combined in a single physical aperture of a flat panel antenna; and generating two RF waves using the first and second sets of elements simultaneously, the two RF waves being in two different frequency bands.

30. The method defined in claim 29 further comprising superimposing the two RF waves with a coupling interface.

31. The method defined in claim 30 wherein the two RF waves are in two different receive bands.

32. The method defined in claim 31 wherein the two receive bands are the Ka and Ku receive bands.

33. The method defined in claim 29 wherein the two frequency bands are a transmit band and a receive band.

34. The method defined in claim 33 wherein transmit and receive bands are the Ku transmit and receive bands, respectively.

35. The method defined in claim 29 further comprising performing reception and transmission simultaneously with the first and second independently operating sets of interleaved antenna elements in the first and second antenna sub-arrays, respectively, of a flat panel antenna.

36. The method defined in claim 29 further comprising performing reception in two different receive bands and pointing at two different sources in two different directions simultaneously.

37. A television reception system comprising:

a single physical antenna aperture having at least two spatially interleaved dual receive antenna sub-arrays of antenna elements operable to perform reception in two different receive bands, wherein each antenna sub-array is operable independently and simultaneously at a specific frequency, wherein each of the at least two spatially interleaved dual receive antenna sub-arrays comprises surface scattering antenna elements and the surface scattering antenna elements of the at least two spatially interleaved dual receive antenna sub-arrays are combined into the single physical aperture;

a set top box coupled to the antenna to process two or more receive streams for a television, wherein the set top box includes analog-to-digital converters, a demodulator and a decoder to process the two receive streams; and a controller coupled to control the antenna aperture.

38. The system defined in claim 37 wherein the controller is operable to control the antenna aperture to switch the polarizations of one or more of the sub-arrays.

39. The antenna defined in claim 37 wherein pointing angles of the at least two antenna sub-arrays are different such that a first antenna sub-array of the at least two antenna sub-arrays is operable to form a beam in one direction and a second antenna sub-array of the at least two antenna sub-arrays is operable to form a beam in a second direction different than the first direction and that the angle between the two beams is greater than 10°.

40. The antenna defined in claim 37 wherein the at least two antenna sub-arrays are operable to point at two different sources in two different directions simultaneously and with switchable polarization states.

41. The antenna defined in claim 37 wherein the two bands comprise the Ka and Ku receive bands.

42. The antenna defined in claim 37 wherein each of the at least two antenna sub-arrays is to operate based on holographic beam forming.

43. The antenna defined in claim 37 wherein each of the at least two antenna sub-arrays comprises a tunable slotted array of antenna elements combined into the single physical aperture.

44. The antenna defined in claim 43 wherein the tunable slotted array for a first of the at least two antenna sub-arrays has a number of elements and element density that is different than that of a second of the at least two antenna arrays.

45. The antenna defined in claim 43 wherein most elements in each of the tunable slots of the at least two antenna sub-arrays are interleaved and spaced with respect to each other.

46. A full duplex communication system comprising:

a single physical antenna aperture having at least two spatially interleaved antenna sub-arrays of antenna elements, wherein the at least two antenna sub-arrays comprise combined transmit and receive antenna arrays of antenna elements operable to perform reception and transmission simultaneously at different frequencies, wherein each of the at least two spatially interleaved antenna sub-arrays comprises surface scattering antenna elements and the at least two spatially interleaved antenna sub-arrays are combined into the single physical aperture;

a receive path coupled to the antenna aperture to process data for reception, wherein the receive path comprises analog-to-digital converters, a demodulator and a decoder to process the data for reception;

a transmit path coupled to the antenna aperture to process data for transmission, wherein the transmit path comprises an encoder, a modulator and a digital-to-analog converter to process the data for transmission; and a controller coupled to control the antenna aperture.

47. The system defined in claim 46 wherein the controller is operable to control the antenna aperture to switch the polarizations of one or more of the sub-arrays.

48. The antenna defined in claim 46 wherein pointing angles of the at least two antenna sub-arrays are different such that a first antenna sub-array of the at least two antenna sub-arrays is operable to form a beam in one direction and a second antenna sub-array of the at least two antenna sub-arrays is operable to receive a beam in a second direction different than the first direction and that the angle between the two beams is greater than 10°.

49. The antenna defined in claim 46 wherein transmission and reception are in the Ku transmit and receive bands, respectively.

50. The antenna defined in claim 46 wherein each of the at least two antenna sub-arrays is to operate based on holographic beam forming.

51. The antenna defined in claim 46 wherein each of the at least two antenna sub-arrays comprises a tunable slotted array of antenna elements combined into the single physical aperture.

52. The antenna defined in claim 51 wherein the tunable slotted array for a first of the at least two antenna sub-arrays has a number of elements and element density that is different than that of a second of the at least two antenna sub-arrays.

53. The antenna defined in claim 51 wherein most elements in each of the tunable slots of the at least two antenna sub-arrays are interleaved and spaced with respect to each other.

* * * * *